US007937901B2

(12) United States Patent
Sarkkinen

(10) Patent No.: US 7,937,901 B2
(45) Date of Patent: May 10, 2011

(54) TENDON-IDENTIFYING, POST TENSIONED CONCRETE FLAT PLATE SLAB AND METHOD AND APPARATUS FOR CONSTRUCTING SAME

(76) Inventor: Douglas L. Sarkkinen, Battle Ground, WA (US)

( * ) Notice: Subject to any disclaimer, the term of this patent is extended or adjusted under 35 U.S.C. 154(b) by 752 days.

(21) Appl. No.: 11/391,921

(22) Filed: Mar. 28, 2006

(65) Prior Publication Data

US 2006/0230696 A1 Oct. 19, 2006

Related U.S. Application Data

(60) Provisional application No. 60/666,371, filed on Mar. 29, 2005.

(51) Int. Cl.
*E04C 5/08* (2006.01)
*E04C 2/06* (2006.01)

(52) U.S. Cl. ..... 52/223.6; 52/742.14

(58) Field of Classification Search ..... 52/602, 52/319, 223.6, 223.8, 742.14
See application file for complete search history.

(56) References Cited

U.S. PATENT DOCUMENTS 1,484,206 A * 2/1924 Birkholz ..... 52/602
2,039,183 A * 4/1936 Nagel ..... 52/602
3,475,529 A * 10/1969 Lacy ..... 264/228
4,432,175 A * 2/1984 Smith ..... 52/223.6
4,514,947 A * 5/1985 Grail ..... 525/36
4,627,203 A * 12/1986 Presswalla et al. ..... 52/220.5
4,901,491 A * 2/1990 Phillips ..... 52/274
4,979,462 A 12/1990 Kramer et al.
5,222,338 A * 6/1993 Hull et al. ..... 52/405.3
5,433,049 A * 7/1995 Karlsson et al. ..... 52/293.2
5,950,390 A * 9/1999 Jones ..... 52/602
6,625,948 B2 * 9/2003 Valente ..... 52/602
2003/0233798 A1 * 12/2003 Berkey et al. ..... 52/223.7

* cited by examiner

*Primary Examiner* — Khoi Tran
*Assistant Examiner* — Jason Holloway
(74) *Attorney, Agent, or Firm* — Mark E. Beatty; Kurt M. Rylander; Rylander & Associates PC

(57) ABSTRACT

A tendon-identifying, post-tensioned, elevated concrete slab, and method and form panel apparatus for constructing the same, provides a distinctively-patterned bottom side slab surface in which the slab has a full thickness dimension extending along each individual post-tensioning uniform and banded tendon embedded within the slab and a reduced-thickness dimension in the areas between each individual, adjacent laterally spaced apart, longitudinally extending uniform tendon of the post-tensioning system, whereby the location of embedded tendons can be identified by the full thickness areas of the slab appearing as prominent, elongated rib-like surfaces extending between inwardly recessed surfaces of the bottom side of the slab.

4 Claims, 5 Drawing Sheets

TENDON-IDENTIFYING, POST TENSIONED CONCRETE FLAT PLATE SLAB AND METHOD AND APPARATUS FOR CONSTRUCTING SAME

This application claims benefit under 35 U.S.C. 119(e) of the priority filing date of earlier filed U.S. Provisional application Ser. No. 60/666,371, filed 29 Mar. 2005.

BACKGROUND OF THE INVENTION

This invention relates to elevated concrete flat plate slab constructions, and more particularly to post-tensioned concrete concrete flat plate slab constructions which include a plurality of embedded, laterally spaced apart, tensioned uniform cable tendons extending in a first, longitudinal direction across the slab and a plurality of longitudinally spaced apart, tensioned banded cable tendons extending in a lateral direction over each row of support columns supporting the slab in elevated condition. In particular, the present invention provides a tendon-identifying post tensioned slab construction that effectively utilizes and combines the structural aspects of one-way slab type construction and two-way slab construction. These slab floor constructions are well known and utilized in the construction of elevated building floors, bridges, multi-level parking structures and many other such structures.

As is well understood in the industry, one type of two-way slab construction is a post-tensioned flat plate slab system which typically provides a concrete slab having a generally uniform thickness throughout. Other generally similar two-way labs may have increased thicknesses at their juncture with and extending between the underlying floor support columns which support them in elevated condition, as s well known.

In post-tensioned flat plate slab construction, preliminary to pouring the concrete for the slab on the temporary concrete formwork, a plurality of individual or bundled post-tensioning cables are positioned for extension from one peripheral edge of the formwork to the opposite longitudinal edge. These cables, known as uniform tendons, are placed at regular laterally-spaced apart points, typically at 36 inches, across the formwork. A plurality of bundled cables, known as banded tendons, are positioned for extension in the direction perpendicular to the extension of the uniform tendons, and placed at longitudinally spaced apart positions along the formwork overlying and extending along each row of underlying floor support columns as is known.

Once the concrete slab has been poured and has hardened, the uniform and banded tendons are placed under a selected pull tension by a hydraulic ram and secured in tension condition, thereby creating the post-tensioned flat plate slab construction. The applied stressing force of the tensioned tendons imparts an overall compressive stress on the slab, and the generally undulating extension of the tendons provide for upward or downward reacting forces depending on the particular configuration. In this regard the post-tensioned tendons create the necessary reacting strength to resist gravity-imposed loading on building structures, typically for floors and roofs.

As previously mentioned, the flat plate slab construction is a two-way type slab construction in which the unsupported span portions are effectively supported so that bending stress in the center of the span area is substantially biaxial. In one-way slab construction, the span between supports extends substantially in one direction, and the bending stress in the center of the span is substantially uniaxial. There is intrinsic structural advantage with two-way action since a uniform thickness homogeneous slab has more stiffness and strength with effective support on four sides of the span than one of the same size with supports on only two.

Further, building codes also distinguish between one-way and two-way tensioned concrete slabs, applying more stringent requirements on one way slabs because of their lesser redundancy and robustness. One-way type slab constructions typically utilize a thinner slab thickness supported by underlying joist members, which may comprise thickened portions of the concrete, extending in one direction at pre-engineered laterally spaced points determined by the architect according to engineering load factors. These supporting joists have no relation to the tendon layout or placement. A two-way flat plate slab type construction provides, as the name suggestions, a uniform thickness flat slab, substantially smooth on top and bottom side surfaces, supported on the underlying columns, the slab generally having a greater uniform thickness than the one-way type slab to provide the necessary rigidity required in the spans between support columns.

In both one-way and two-way post-tensioned slab constructions, the uniform and banded tendons are embedded within the interior of the concrete slab in their own predetermined layout and arrangement which is obviously completely hidden from view from either above or below the finished elevated concrete slab construction. However with it understood that, both during construction of a building and afterwards in renovation, etc., workers often need to drill into the bottom side of a floor slab for securing attachments and for drilling through the floor for electrical, plumbing, air handling and other reasons. It is therefore easy for one to understand how necessary it is to assure that a person does not drill or bore into the slab and inadvertently strike or sever one of the highly-tensioned post tensioning tendons in the process. Heretofore in order to identify the location of tensioning tendons to determine safe and suitable places to drill and bore, it has been necessary to enlist the use of X-ray or ground penetrating radar devices. Other attempts have been made to identify the location of post tensioning cables by the provision of dedicated, permanently embedded marker devices installed during the placement of the uniform and banded tendons. These devices provide visual marking of the extending tendons by providing a projecting member which extends beneath the bottom surface of the concrete slab, such as that disclosed in U.S. Pat. No. 4,979,462 to Kramer et al.

SUMMARY OF THE INVENTION

In its basic concept, this invention provides a post tensioned flat plate slab, and method and apparatus for forming a concrete slab, that has a slab geometry in which the thickness of the slab in the areas inbetween the individually-extending uniform and banded tendons is in the range of 60% to 90%, and preferably approximately 75%, of the thickness of the remaining area of the slab, forming inwardly recessed surface areas visible from the bottom side of the slab identifying safe areas for drilling and boring of the slab between tendons and for optimizing the efficient and cost effective utilization of concrete in building construction.

It is by virtue of the foregoing basic concept that the principal objective of this invention is achieved; namely, the provision of a post-tensioned flat plate slab arrangement that provides for the permanent and immediate visual identification of the location and layout of the uniform and banded tendons embedded within the slab and also effectively and selectively combines the different individual structural characteristics, behaviors and advantages of one-way slab systems and two-way systems to provide a flat plate slab arrangement that incorporates the advantages of the structural behavior of post tensioned slab construction having two-way action while also utilizing the concrete saving benefits found in one-way slab constructions.

Another objective and advantage of this invention is the provision of a two-way concrete flat plate slab construction of the class described which utilizes less concrete material volume than conventional flat plate type constructions of equal size, with corresponding reduced expense required for the concrete material used in construction.

Another objective and advantage of this invention is the provision of a concrete flat plate slab construction of the class described which, by virtue of its use of a reduced volume of concrete material, results in a decreased slab mass and commensurate decrease in total building mass for seismic loading and related structural requirements.

Another objective and advantage of this invention is the provision of a concrete flat plate slab construction of the class described which allows for a decrease in post-tensioning due to less dead load of the building structure.

Still another objective and advantage of this invention is the provision of a concrete flat plate slab construction of the class described which results in less overall load on building foundations and slab support columns with corresponding reduction in foundation and column structural requirements and cost.

A further objective and advantage of this invention is the provision of a concrete slab construction of the class described which is accomplished substantially only through the provision of reusable, temporary concrete form panel members which are removed with the temporary concrete form work after slab construction, the form panel members then being available for repeated reuse in subsequent slab constructions, thereby avoiding the expense of the purchase and installation of dedicated, permanent tendon-identifying marker apparatus permanently embedded in the finished slab, as heretofore required for visual tendon identification by the prior art.

A still further objective and advantage of this invention is the provision of a method of constructing a flat plate, post-tensioned concrete slab which, while minimizing the amount of concrete being used while still maintaining two-way structural behavior, further results in a flat plate slab that has a bottom side surface having distinct surface patterns of outwardly raised rib-like portions and inwardly recessed plane-like areas which respectively identify the location of all embedded post tensioning tendons (uniform and banded) and safe areas therebetween which are suitable for drilling, boring and coring of the slab without possibility of damage to the embedded tendons.

The foregoing and other objects and advantages of the present invention will appear to those skilled in the art from the following detailed description, taken in connection with the accompanying drawings of a preferred embodiment.

DESCRIPTION OF THE PREFERRED EMBODIMENT

Figure 1:
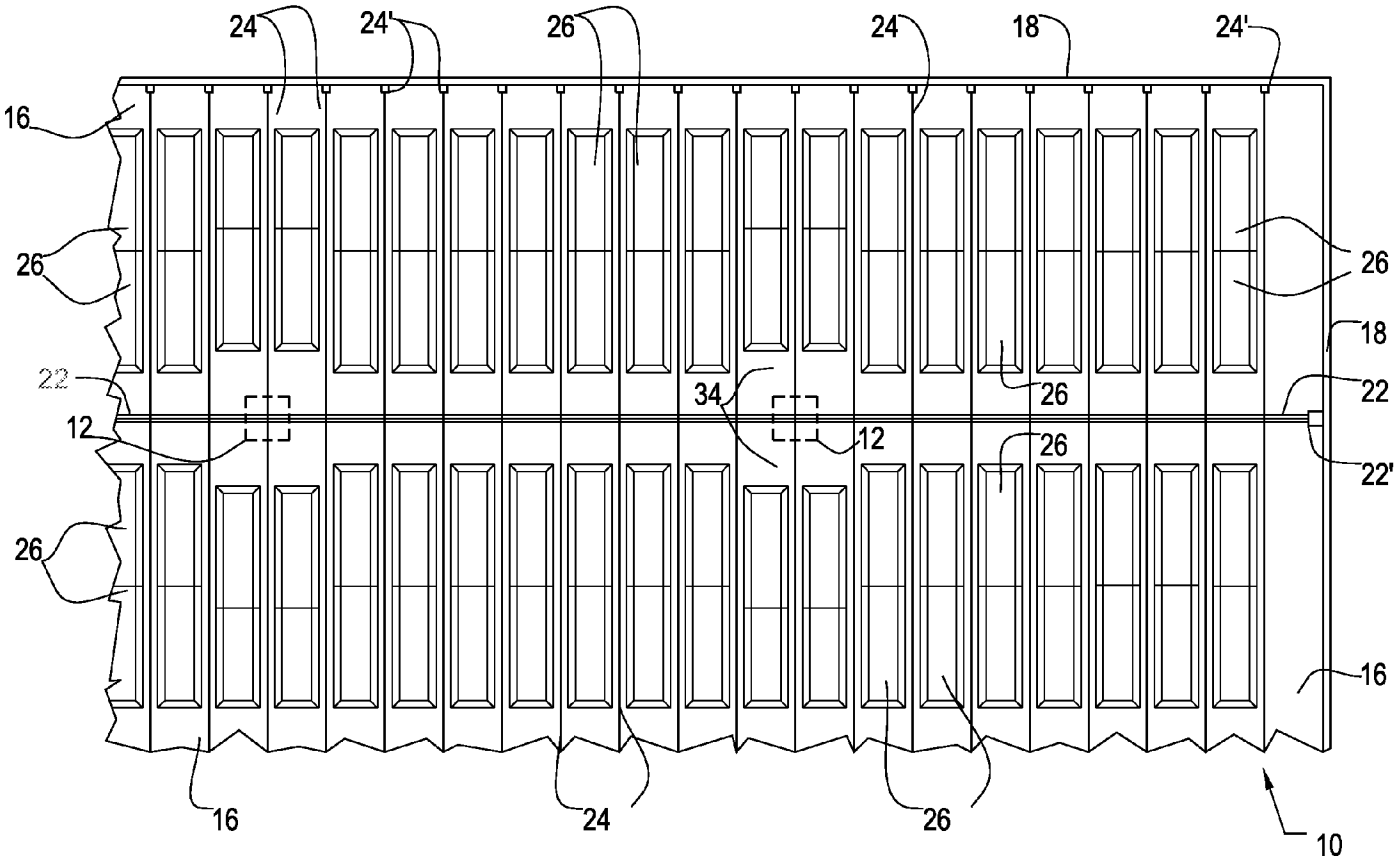
FIG. 1 is a fragmentary top plan view of a corner portion of an elevated concrete flat plate slab floor formwork having a flat plywood bottom and upstanding peripheral wood form board walls, with uniform and banded post-tensioning tendons and anchors positioned according to engineering specifications and with a plurality of concrete form panel members of this invention arranged on the flat plywood bottom in the spaces between each uniform tendon.

FIG. 1 is a fragmentary top plan view of a corner portion of a typical, temporary, elevated concrete flat plate type slab floor formwork structure 10 erected around the topmost portion of a plurality of previously-constructed, upstanding support columns 12 and supporting a plurality of form panel members to be described later. The upper ends of the columns are arranged for communication with the interior of the concrete slab formwork 10 as is well understood in the art.

Figure 3:
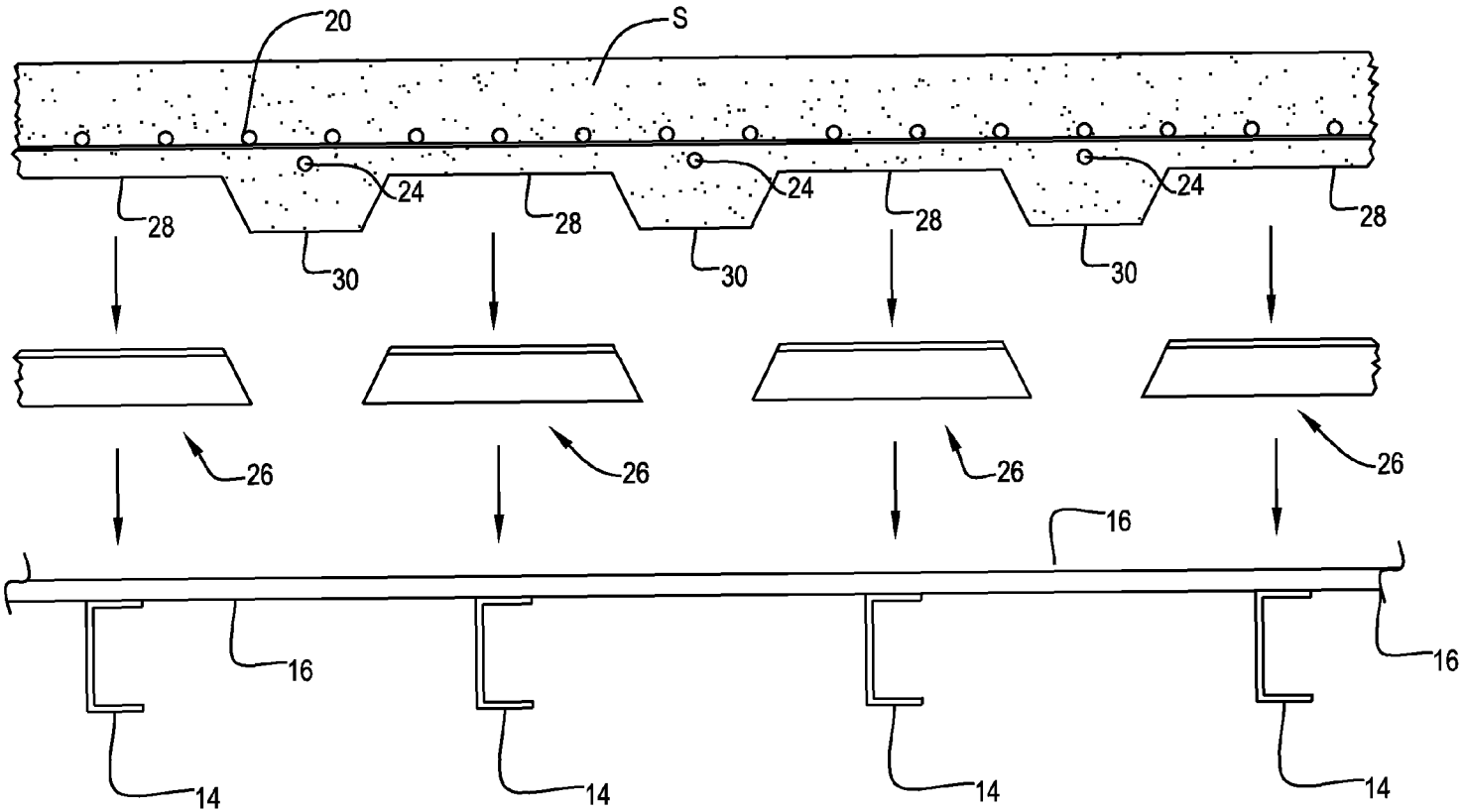
FIG. 3 is a fragmentary vertical elevation of a finished concrete flat plate slab embodying features of this invention as would be viewed along the line 3-3 in FIG. 2 but after the concrete has been poured and hardened, the temporary concrete formwork and form panels of this invention being shown exploded away to show the temporary formwork separated after the concrete slab has hardened.

As will be appreciated in viewing FIGS. 1 and 3 of the drawings, a temporary concrete flat plate slab formwork 10 typically provides an elevated, concrete-confining, support base structure having a plurality of floor joists 14 supported in an elevated condition by temporary upright posts (not shown). The floor joists in turn support a plurality of plywood sheets 16 which form a flat, temporary floor surface extending around the tops of the permanent columns 12 throughout the entire area of the future concrete slab floor to be constructed. The outer peripheral edges of the temporary form floor 16 are enclosed with upstanding peripheral form boards 18 which create a flat, box-like cavity to be filled with and contain liquid concrete until it hardens, as is well understood in the concrete industry.

It should be noted herein that, although the concrete slab formwork 10, 14-18 is being shown herein in the form of generic, wood members for purposes of simplicity of illustration, any configuration and arrangement of the number of proprietary concrete form systems that are commercially available in the industry may of course be alternatively utilized. The illustrated formwork 10, 14-18 is intended herein to be merely representative of basic, known structures and elements.

Typically, after the aforementioned concrete formwork 10 is erected, the tendon layout for both the banded and the uniform tendons is marked on the formwork. Then in typical concrete slab constructions, a bottom mat of rebar 20 is installed in the interior over the bottom surface area of the formwork, and punching shear reinforcing (not shown) at the column locations 12 is installed.

Typically, once tendon support bars (not shown) are placed, the banded tendons 22 are installed so as to extend in their longitudinal direction in condition overlying a row of columns 12 from one side peripheral edge of the formwork to the opposite peripheral side edge, as is known in the art. Tendon-tensioning, end anchor members 22' are positioned at the outer peripheral of the formwork for embedding within the concrete slab. Then the uniform tendons 24 and tensioning anchors 24' are installed such that the uniform tendons extend in their longitudinal direction perpendicularly to the direction of the longitudinal extension of the banded tendons 22 from one peripheral outside edge of the formwork to the corresponding opposite peripheral edge of the formwork.

The uniform tendons are spaced apart laterally, as shown, at regular, predetermined intervals as predetermined by engineering requirements in the particular building construction. This lateral spacing of the uniform tendons 24 may vary from approximately 18 inches to 40 inches, but a typical spacing provides for uniform tendons to be spaced laterally apart on 36 inch centers.

Following placement of the uniform tendons 24 within the formwork, a top mat (not shown) of reinforcing rebar is installed typically at the column reinforcing. Edge reinforcing, hairpins for bursting reinforcing, is installed at the end anchorages, and plumbing inserts and other blockouts (all not shown) are installed prior to final inspection of the reinforcing and post tensioning structure preliminary to pouring of the concrete material.

After the concrete has been poured and finished into a uniform thickness, the concrete hardens into a concrete slab S and is allowed to cure for approximately three days. When the concrete reaches sufficient hardness, the banded and uniform tendons are individually stressed and locked in tensioned condition, in well known manner.

Finally, the concrete formwork 10 is dismantled and removed from the underside of the concrete slab S, whereupon the concrete slab has a substantially uniform thickness throughout with substantially smooth, uniform top and bottom surfaces. In a multi-level building structure, new upright columns 12 are then erected to extend upwardly from the upper surface of the newly constructed concrete slab, after which the previously described elevated concrete slab formwork 10 is reconstructed in elevated condition on temporary support posts using the underlying new slab floor construction as support, as is well understood in the art.

Having thus described the heretofore conventional, general construction of a basic post tensioned flat plate slab floor for background reference, attention will now be directed to the drawings in connection with the present invention. In this regard, FIG. 1 shows that, after a typical concrete slab formwork 10 has been erected, and after the positions of the banded and uniform tendons have been marked on the formwork, and before the bottom mat 20 of rebar is installed, a plurality of shallow concrete form panel members 26 of this invention are laid on the flat temporary floor base 16 of the formwork 10 and positioned in regularly laterally spaced apart, longitudinally extending condition in elongated rows centrally between the marked location of each uniform tendon 24.

In the particular embodiment illustrated herein, a typical concrete slab formwork 10 is provided for construction of a typical 8 inch thick flat plate slabs having support columns 12 placed on a 27 ft. by 27 ft. column grid pattern. As is typical in such an arrangement, the uniform tendons 24 are spaced apart laterally from each other on approximately 36 inch centers. The form panel members 26 in this case have an overall width dimension of 30 inches, as will be discussed later.

The uniform tendons extend longitudinally in a common first direction (top to bottom in FIGS. 1 and 2) from one peripheral edge of the concrete slab formwork to the opposite peripheral edge (not shown) thereof. The banded tendons 22 extend longitudinally perpendicularly relative to the uniform tendons 24, and are as shown spaced apart so as to extend along rows of aligned columns 12.

As mentioned, in this example where uniform tendons are spaced apart at 36 inch intervals, the longitudinally-elongated form panel members 26 of this invention are each arranged with an overall width of 30 inches, the panels being positioned centrally between each marked, laterally spaced apart uniform tendon location. In this manner, laterally adjacent panel members are laterally spaced 6 inches apart from each other at the location for positioning of each uniform tendon run.

As will be apparent to those skilled in the art, this arrangement provides for a full-thickness concrete slab from the formwork bottom 16 to the top of the confining peripheral form boards 18 along the line of longitudinal extension of each uniform tendon between each laterally adjacent row of panel members 26. However, since the areas inbetween each longitudinally elongated tendon position are occupied by the panel members 26, the resulting slab will have a reduced thickness in these areas.

Figure 7:
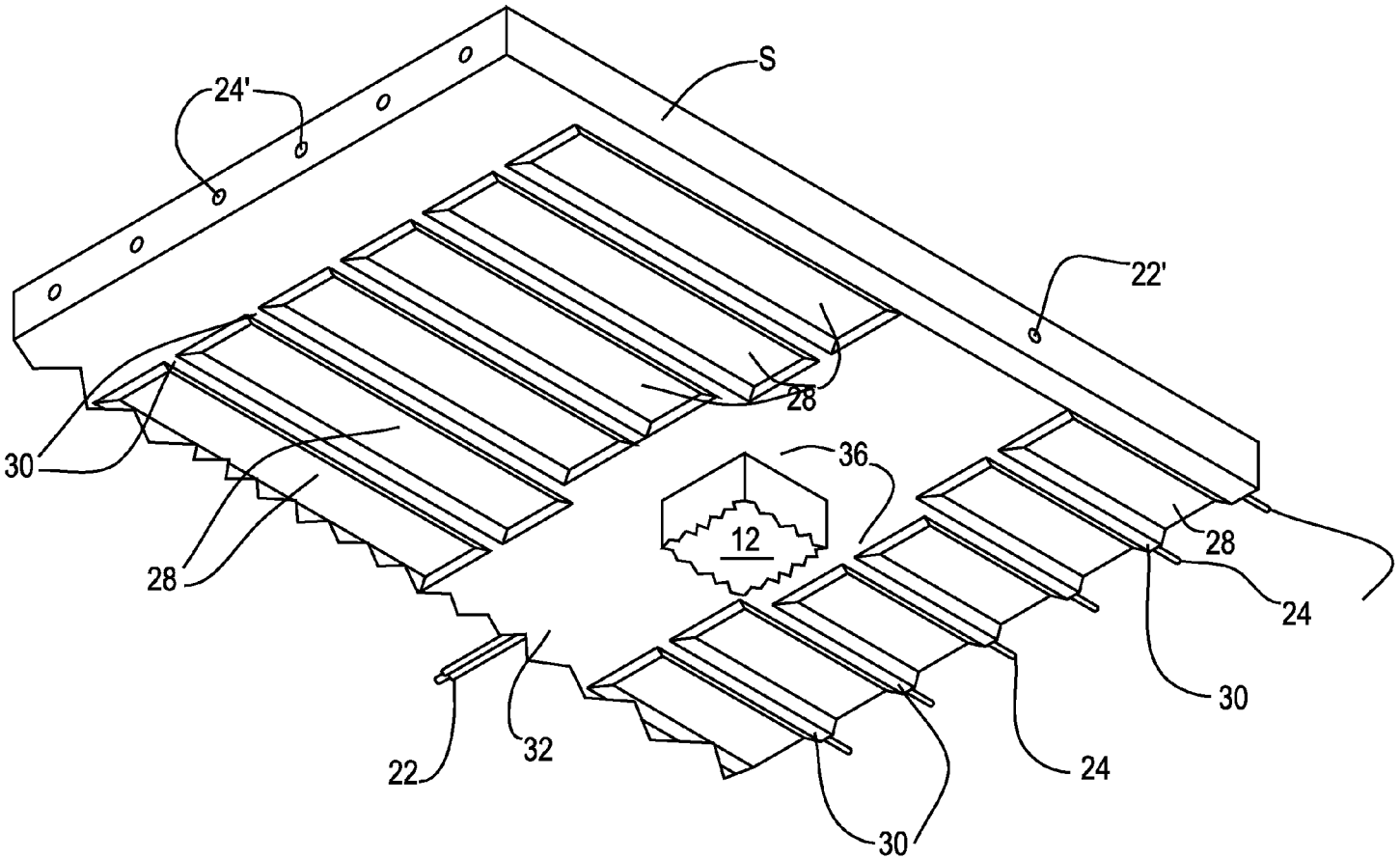
FIG. 7 is a fragmentary bottom perspective view of a portion of a finished slab construction of this invention as would be seen by a viewer from below, and showing the inwardly-recessed, reduced thickness areas of the slab left after removal of the form panels identifying safe areas for drilling and boring, and also showing the non-recessed, full-thickness areas of the slab which indicate the layout and locations of extending tendons embedded within the slab.

Upon eventual removal of the concrete formwork 10 and panel form members 26 upon completion of the slab construction, the view of the underside surface of the finished concrete slab S will clearly reflect, as shown in FIGS. 3 and 7, that the reduced-thickness slab areas, formerly occupied by the panels 26 appear, as inwardly-recessed surface areas 28, and the full-thickness slab areas along each longitudinally extending run of uniform tendons 24 appear as downwardly projecting, longitudinally extending rib-like surfaces 30. This distinctive bottom surface pattern on the bottom side of the slab therefore clearly identifies, at a glance, the precise layout arrangement and location of the embedded tendons 22, 24 extending throughout the slab area.

As understood in viewing FIGS. 1 and 7, the longitudinal extension of each laterally spaced row of panels 26 from one perimeter edge of the form to the opposite perimeter edge is interrupted to accommodate the longitudinal extension of the banded tendons 22 extending in the perpendicular direction along aligned rows of support columns 12, as shown. As is understood in the industry, banded tendons 22 are provided in groupings (not shown) having overall widths between 4 to 8 ft., with a 6 ft. width being typical. Therefore, the interruptions in the longitudinally extending rows of panels 26 provides for a full-thickness, wider rib-like slab surface 32 extending along each run of banded tendons when viewed from the bottom of the finished slab. Also, at locations 34 directly adjacent individual columns 12, the rows of form panel members may be provided with reduced overall lengths relative to the other rows in order to provide an enlarged, full-thickness concrete slab area 36 overlying and surrounding the top of each column 12 location for punching shear strength and additional reinforcing as necessary as is well understood by those skilled in the industry.

As will also be readily apparent in FIG. 7, once the concrete slab S has been completed and all formwork 10, 14-18 and 26 has been removed from beneath the new, finished slab, the full-thickness areas 32 provided along the banded tendons 22 extending in rows along upright columns 12 in the direction perpendicular to the downwardly projecting, narrow rib patterns 30 will appear from the underside of the slab as wide, (six foot wide in this example), downwardly projecting rib-like areas 32. This indicates at a glance the precise location of the embedded banded tendons 22. Thus, the precise location of all of the individual uniform tendons 24 and banded tendons 22 are immediately identifiable to a person viewing the underside surface of the completed slab by the downwardly projecting rib patterns 30, 32 thus described. The safe areas for drilling, boring and coring are immediately identifiable by the inwardly recessed surface areas 28 of the underside of the slab formed by the temporary concrete form panel members 26 of this invention.

Figure 4:
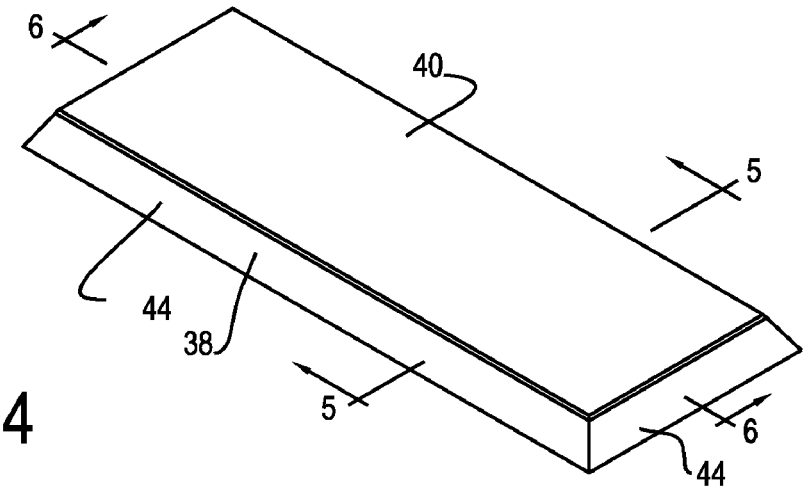
FIG. 4 is a top perspective view of a concrete form panel embodying features of this invention.
Figure 6:
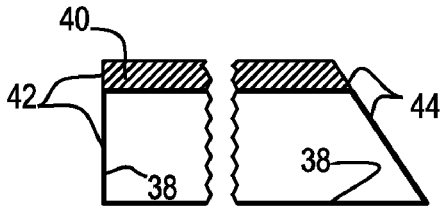
FIG. 6 is a foreshortened sectional view taken along the line 6-6 in FIG. 4.
Figure 5:
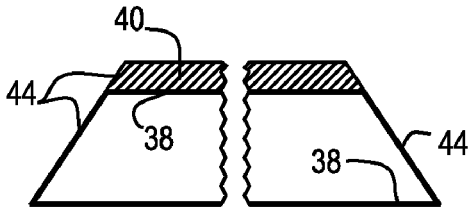
FIG. 5 is a foreshortened sectional view taken along the line 5-5 in FIG. 4.

Turning now specifically to the concrete form panel members 26 of the present invention, reference is now made to FIGS. 4, 5 and 6 of the drawings which illustrate in closer detail an embodiment of a preferred form panel member construction embodying features of the present invention. In this regard, FIG. 4 is a top perspective view of an illustrative rectilinear form panel member 26 which may, as illustrated, comprise an enclosing peripheral support base frame 38 having predetermined overall width, length and height dimensions and forms an underlying, flat, supporting base frame structure arranged for supporting an overlying top panel member 40 having corresponding predetermined length and width dimensions. Securement of the top panel member 40 to the top surface of the base frame 38 may be provided in any desired, suitable manner, such as by screws, rivets, bonding or integral formation therewith. In this, it will be recognized that the base frame structure may be formed of any desired material suitable for the purpose such as metal, synthetic thermosetting resin, wood or other substantially rigid material selected for the purpose. Additional reinforcing frame members (not shown) may be provided as needed to assure structural rigidity and strength of the base frame.

Similarly, the top surface panel member 40 may be formed of plywood, wood product, metal, plastic, fiberglass or other composite material having sufficient strength to allow for handling, installation, walking on by workmen while placing tendons, reinforcing material and concrete, and for ultimate separation and removal of the form member from the concrete material once hardened. The panel member therefore needs to have sufficient stiffness so as not to deflect substantially under the load of the liquid concrete placed thereon so that the final concrete surface is flat. The form panels 26 also need to be of durable construction for longevity throughout multiple uses.

The use of plywood or other wood product as the top surface panel member 40 provides further advantage in that it allows fasteners to be readily attached. Various such fasteners are required for plumbing sleeves, electrical members, stud rails, reinforcing and other structures cast into a slab that require stability during placement and working of the fresh concrete around them. The combination of the panel member base frame 38 and top surface panel member 40 must also be capable of transmitting the weight and load of fresh concrete material and workers moving about thereon to the support base 16 of the concrete slab form system 10 in order to distribute the weight imposed on the panel member 26 evenly onto the formwork 10 below.

Figure 2:
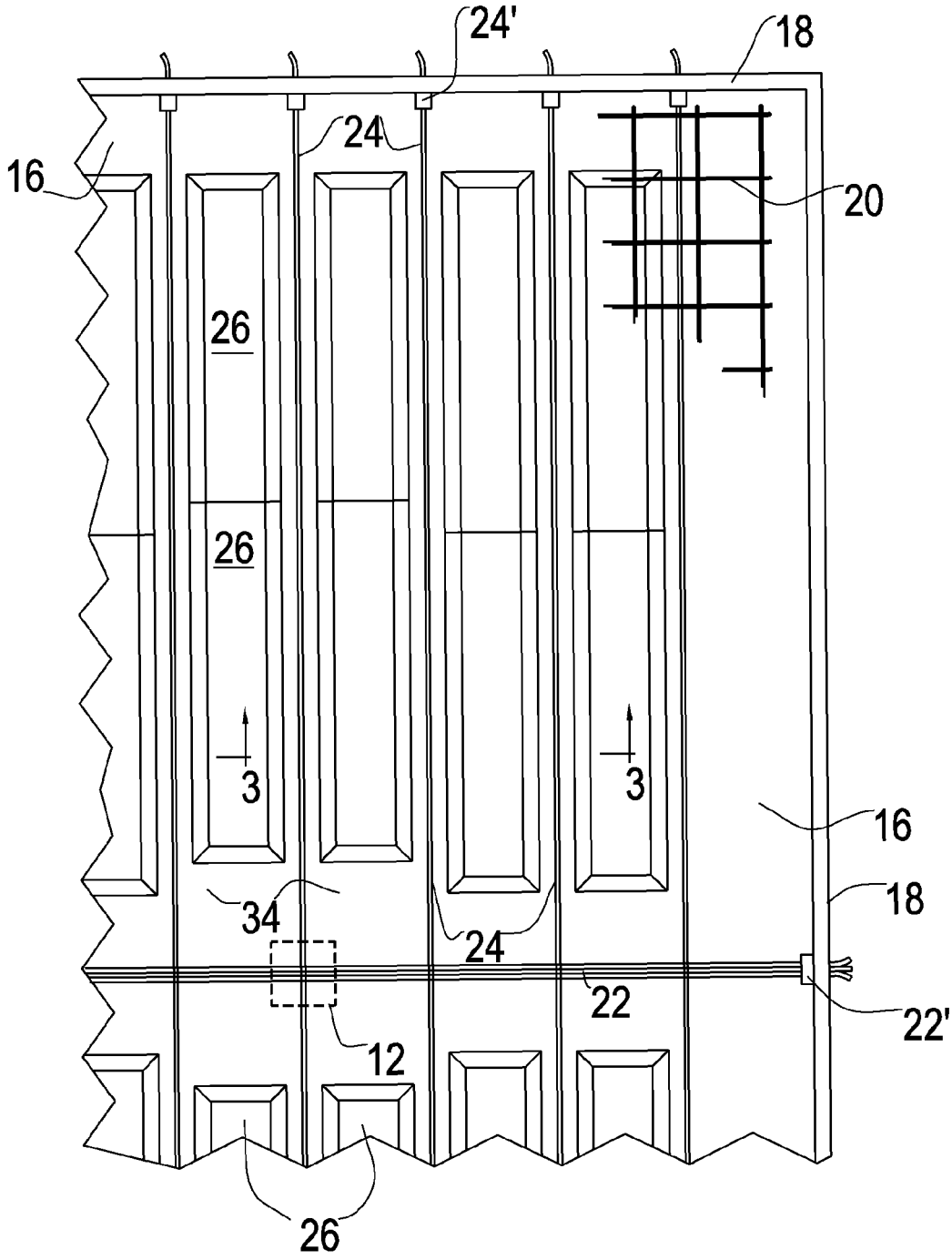
FIG. 2 is a fragmentary top plan view, on a slightly enlarged scale, of another formwork layout generally similar to the arrangement of FIG. 1 but showing a closer detail and the placement of a bottom mat of reinforcing rebar following placement of the form panels.

As mentioned previously, the width of the form panel members 26 is selected according to the particular spacing between uniform tendon placement called for in the engineering specifications of the concrete slab being formed. Thus, the panel member width may vary according to the predetermined uniform tendon spacing called for in a given construction, with approximately a 30 inch panel member width being typical, since a 36 inch uniform tendon spacing is typical. Although the panel form members 26 of this invention may be provided as full length, single members arranged to extend between the positions of the banded tendon locations, it is recognized that such a long form member would be heavy and awkward for handling by the workmen. Therefore it is preferred that the length of each panel form member 26 be limited to approximately 8 ft. overall, and preferably arranged for end-abutting placement of a plurality of longitudinally-oriented panel members to form the overall length desired between banded tendon locations, as shown in FIGS. 1 and 2. To this end, panel form members having lengths of 3 ft., 4 ft. and other selected lengths may also be provided as needed to accomplish virtually any overall desired row length required in different given constructions.

As has also been discussed hereinbefore, an important feature of the panel members is that the overall thickness of the form panel members of this invention is based upon and determined by the maximum, full thickness dimension of the concrete slab S being formed in a given construction. In this regard, the overall thickness of a panel form member of this invention may vary typically from approximately one inch to approximately 4 inches or more depending upon the intended full thickness dimension of the particular concrete slab being built.

In this, and as has been discussed hereinbefore, the thickness of the concrete form panels 26 of this invention is selected so as to provide for a reduced thickness of overlying concrete material that is in the range of between 60% to 90% of the full thickness of the finish concrete slab being constructed. Put differently therefore, the thickness of the concrete form panel members 26 of this invention is selected to be between 10% to 40% of the overall, full thickness of the concrete slab being constructed.

The reason for this required ratio range of relative full and reduced slab thickness is to assure that two-way slab action is maintained. Slabs with too-thin a minimum-thickness, recess 28 dimension between full thickness ribs 30, 32 will not have sufficient stiffness to act as a two-way slab construction. The geometry of the slab and range of thickness covered by this invention meet the qualifications for a two-way system for both the serviceability limit state and the strength limit state as is well understood in the industry.

With further regard to FIGS. 4-6 of the drawings, the peripheral edges of the panel members may if desired be arranged in the form of a square end edge 42, although it has been determined that this can make separation and removal of the form board from the hardened concrete material difficult. Preferably, and as shown in FIG. 4, the outer peripheral edges 44 of the panel member are arranged to taper inwardly from the bottom edge of the form member to the top edge. This arrangement provides for facilitated removal of the form boards, from the hardened concrete material from the underside of the slab during removal of the temporary concrete form work.

Also, it may be desirable, as shown in FIG. 3, that for purposes of facilitating the end abutment of aligned panel members to form longitudinally extending rows, as discussed earlier, panel members may be provided with a flush end wall edge 42 at one of their longitudinal ends for abutment with a corresponding square end wall edge of a second panel member. The other peripheral walls of the form panel members are arranged with inwardly tapered edges 44 for assisting in the separation and removal of the form panel members from the hardened concrete after construction of the slab has been completed.

Having thus described my concrete flat plate slab construction and the concrete form panel member arranged to produce the slab construction of this invention, a typical construction of a post-tensioned flat plate slab embodying features of this invention is as follows: After permanent support columns 12 or other foundational support structure have been constructed, a typical, box-like flat plate type concrete floor formwork 10, 14-18 is erected in conventional manner for the purpose of temporarily receiving and containing liquid concrete in an elevated position above the underlying support columns until the liquid concrete has hardened and supported by the upstanding support columns. The particular tendon layout for both the banded and uniform tendon placement is then marked on the formwork.

A plurality of concrete form panel members 26 are provided with a selected width dimension that is less than the predetermined spacing between adjacent, spaced apart uniform tendons, the form panel members having a predetermined thickness dimension selected to be within the range of 10% to 40% of the maximum thickness of the concrete slab to be formed. The plurality of panel members are placed on the concrete formwork in laterally spaced apart, longitudinally extending rows centrally between each uniform tendon location. A bottom mat of rebar 20 is installed in position over the bottom of the formwork and the concrete form panel members.

The banded and uniform tendons 22, 24 are installed in the locations previously marked, the uniform tendons extending longitudinally in the space between each row of adjacent panel members 26. Desired plumbing inserts and other blockouts are then installed and concrete is poured, typically in a uniform thickness, so as to fill the concrete formwork to the predetermined maximum thickness of the concrete slab being formed.

The concrete is then allowed to cure until the slab reaches a concrete strength of approximately 3,000 psi, whereupon the tendons are individually stressed and secured in tensioned condition in conventional manner. The temporary concrete formwork is then removed and the concrete form panel members 26 are removed from the bottom side of the slab. The resulting surface pattern of the bottom surface of the concrete slab presents inwardly recessed areas 28 left after removal of the concrete form panels which identify safe areas for drilling, and full thickness, rib-like non recessed portions 30, 32 which identify the location and layout of the banded and uniform tendons 22, 24 now embedded within the hardened concrete.

From the foregoing it will be apparent to those skilled in the art that many changes other than those previously described may be made in the size, shape, type, number and arrangement of parts described hereinbefore and in the steps and order of the steps of the method described hereinbefore without departing from the spirit of this invention and the scope of the appended claims.

Having thus described my invention, I claim:

1. A method of providing visual identification of the location within an elevated concrete slab of a plurality of uniform individual, parallel, spaced-apart, elongated post-tensioning tendons extending in a first direction between opposing peripheral side edges of said concrete slab and at least one elongated banded post-tensioning tendon extending in a second direction approximately perpendicular to said uniform tendons, said plurality of uniform tendons and at least one banded tendon embedded within the interior of said elevated concrete slab approximately with the same plane, the method comprising:

a) providing said concrete slab with a uniform level top surface;

b) providing the bottom side surface of said concrete slab with visibly distinct first and second bottom side surface patterns arranged with said first surface pattern having a first uniform full slab thickness underlying and extending along each of said uniform post-tensioning tendons and each of said at least one banded post-tensioning tendons, and with said second surface pattern having a second uniform partial slab thickness in the range of 60% to 90% of said first full slab thickness, said second surface pattern underlying spaces between each of said uniform post-tensioning tendons and each of said at least one banded post-tensioning tendons, and c) designating said first and second bottom side surface patterns as identifying, respectively, the location of and absence of embedded post-tensioning tendons extending within the interior of the slab.

2. The method of claim 1 wherein said second bottom side surface pattern is an inwardly recessed surface of the bottom side of the slab.

3. A tendon-identifying, post-tensioned, elevated concrete slab having:

top and bottom sides, said top side having a uniform level surface;

a plurality of individual, embedded, laterally spaced-apart, longitudinally elongated uniform post-tensioning tendons extending in a first direction between opposing peripheral side edges of the slab;

at least one embedded, longitudinally elongated banded post-tensioning tendon extending in a second direction, substantially perpendicularly to the direction of extension of said uniform post-tensioning tendons, extending between opposing peripheral side edges of the slab, each of said at least on banded tendon disposed in approximately the same plane as said plurality of uniform post-tensioning tendons; and, said slab further including predetermined full slab thickness portions between said top and said bottom side extending along each of said uniform post-tensioning tendons and along each of said at least one banded post-tensioning tendons, and predetermined reduced slab thickness portions within each of the spaces defined by said uniform post-tensioning tendons and said at least one banded post-tensioning tendon;

said reduced slab thickness portions being in the range of 60% to 90% of the thickness of said full slab thickness portions and providing inward recesses in the bottom side surface of the slab indicating areas inbetween said uniform post-tensioning tendons and said at least one banded tendon embedded in the slab.

4. The concrete slab of claim 3 wherein said reduced slab thickness portions are approximately 75% of the thickness of said full slab thickness portions.

* * * * *